US008358070B2

(12) United States Patent
He et al.

(10) Patent No.: US 8,358,070 B2
(45) Date of Patent: Jan. 22, 2013

(54) LANTHANIDE OXIDE AS AN OXYGEN DISPENSER IN A METAL HALIDE LAMP

(75) Inventors: Jianmin He, East Cleveland, OH (US); Zoltan Toth, Budapest (HU); Timothy David Russell, North Ridgeville, OH (US)

(73) Assignee: General Electric Company, Schenectady, NY (US)

( * ) Notice: Subject to any disclaimer, the term of this patent is extended or adjusted under 35 U.S.C. 154(b) by 272 days.

(21) Appl. No.: 12/270,216

(22) Filed: Nov. 13, 2008

(65) Prior Publication Data

US 2009/0146570 A1 Jun. 11, 2009

Related U.S. Application Data

(63) Continuation-in-part of application No. 11/951,677, filed on Dec. 6, 2007, now Pat. No. 7,868,553.

(51) Int. Cl.
*H01J 17/20* (2006.01)

(52) U.S. Cl. ..... 313/637; 252/181.1; 313/640; 313/638

(58) Field of Classification Search ..... 313/623, 313/627–643, 567, 111–117, 25–27, 318.01–318.09; 439/615, 739, 26, 29, 22; 445/24, 26, 29, 445/22; 252/181.1
See application file for complete search history.

(56) References Cited

U.S. PATENT DOCUMENTS

| | | | | |
|---|---|---|---|---|
| 4,319,158 | A * | 3/1982 | Watanabe et al. | 313/346 R |
| 4,422,011 | A * | 12/1983 | Bruninx-Poesen et al. | 313/642 |
| 4,806,826 | A * | 2/1989 | White et al. | 313/631 |
| 5,081,396 | A * | 1/1992 | Schneider et al. | 313/630 |
| 5,866,982 | A | 2/1999 | Scott et al. | |
| 5,986,405 | A | 11/1999 | DeMaagt et al. | |
| 6,060,829 | A * | 5/2000 | Kubon et al. | 313/631 |
| 6,346,495 | B1 | 2/2002 | Dynys et al. | |
| 6,356,016 | B1 | 3/2002 | Suijker et al. | |
| 6,362,571 | B1 | 3/2002 | Suijker et al. | |
| 6,796,869 | B1 * | 9/2004 | Coxon et al. | 445/26 |
| 7,215,081 | B2 | 5/2007 | Bewlay et al. | |
| 7,323,422 | B2 * | 1/2008 | Raaijmakers et al. | 438/758 |
| 2001/0011872 | A1 * | 8/2001 | Matsumoto et al. | 313/631 |

(Continued)

FOREIGN PATENT DOCUMENTS

JP 57 128446 A 8/1982

(Continued)

OTHER PUBLICATIONS

E.A. de Graaf et al, Selective hydrogen oxidation in a mixture with ethane/ethene using cerium zirconium oxide, May 20, 2004, Science Direct, Applied Catalysis A: General, vol. 262, Issue, pp. 201-206.*

(Continued)

*Primary Examiner* — Mariceli Santiago
*Assistant Examiner* — Donald Raleigh
(74) *Attorney, Agent, or Firm* — Fay Sharpe LLP

(57) ABSTRACT

A lamp includes a discharge vessel. Tungsten electrodes extend into the discharge vessel. An ionizable fill is sealed within the vessel. The fill includes a buffer gas and a halide component that includes a rare earth halide. A source of oxygen which includes a lanthanide oxide is present in the discharge vessel. The source of oxygen provides oxygen for a regenerative cycle which reduces blackening of the lamp walls by tungsten from the electrodes.

21 Claims, 3 Drawing Sheets

U.S. PATENT DOCUMENTS

| | | | | |
|---|---|---|---|---|
| 2001/0052754 | A1* | 12/2001 | Miyanaga | 313/632 |
| 2004/0144729 | A1* | 7/2004 | Witham et al. | 210/721 |
| 2005/0031517 | A1* | 2/2005 | Chan | 423/263 |
| 2005/0248279 | A1 | 11/2005 | Lambrechts et al. | |
| 2006/0164016 | A1* | 7/2006 | Rintamaki et al. | 313/638 |
| 2006/0164017 | A1 | 7/2006 | Rintamaki et al. | |
| 2006/0208635 | A1* | 9/2006 | Lenef et al. | 313/567 |

FOREIGN PATENT DOCUMENTS

| | | | |
|---|---|---|---|
| JP | 10 312751 | A | 11/1998 |
| WO | WO 99/53522 | | 10/1999 |
| WO | WO 99/53523 | | 10/1999 |
| WO | WO 99/53523 | A | 10/1999 |
| WO | WO 2005/088675 | | 9/2005 |
| WO | WO 2009/075943 | A | 6/2009 |

OTHER PUBLICATIONS

Takeshi Miki et al, Enhanced Oxygen Storage Capacity of cerium Oxides in CeO2/La2O3/AI2O3 containing precious metals, Journal of Physical Chemistry, 1990, vol. 94, No. 16, p. 6464-6467.*

U.S. Appl. No. 11/951,677, filed Dec. 6, 2007, Russell, et al.

* cited by examiner

LANTHANIDE OXIDE AS AN OXYGEN DISPENSER IN A METAL HALIDE LAMP

This application claims the benefit, as a continuation-in-part, of application Ser. No. 11/951,677, filed Dec. 6, 2007, now U.S. Pat. No. 7,868,553 the disclosure of which is incorporated herein in its entirety by reference.

BACKGROUND OF THE DISCLOSURE

This disclosure relates to a discharge lamp with high lumen maintenance. It finds particular application in connection with a metal halide lamp (both in quartz and ceramic implementations) with a lanthanide oxide (an oxide of a lanthanide series element) as a source of available oxygen in the vessel that, during lamp operation, maintains a difference in solubility for tungsten species between the wall and the electrodes, and will be described with particular reference thereto.

High Intensity Discharge (HID) lamps are high-efficiency lamps that can generate large amounts of light from a relatively small source. These lamps are widely used in many applications, including highway and road lighting, lighting of large venues such as sports stadiums, floodlighting of buildings, shops, industrial buildings, and projectors, to name but a few. The term "HID lamp" is used to denote different kinds of lamps. These include mercury vapor lamps, metal halide lamps, and sodium lamps. Metal halide lamps, in particular, are widely used in areas that require a high level of brightness at relatively low cost. HID lamps differ from other lamps because their functioning environment requires operation at high temperature and high pressure over a prolonged period of time. Also, due to their usage and cost, it is desirable that these HID lamps have relatively long useful lives and produce a consistent level of brightness and color of light. Although in principle, HID lamps can operate with either an alternating current (AC) supply or a direct-current (DC) supply, in practice, the lamps are usually driven via an AC supply.

Discharge lamps produce light by ionizing a vapor fill material, such as a mixture of rare gases, metal halides and mercury with an electric arc passing between two electrodes. The electrodes and the fill material are sealed within a translucent or transparent discharge vessel that maintains the pressure of the energized fill material and allows the emitted light to pass through it. The fill material, also known as a "dose," emits a desired spectral energy distribution in response to being excited by the electric arc. For example, halides provide spectral energy distributions that offer a broad choice of light properties, e.g. color temperatures, color renderings, and luminous efficacies.

Such lamps often have a light output that diminishes over time due to blackening of the discharge vessel walls. The blackening is due to tungsten transported from the electrode to the wall. It has been proposed to incorporate a calcium oxide or tungsten oxide oxygen dispenser in the discharge vessel, as disclosed, for example in WO 99/53522 and WO 99/53523 to Koninklijke Philips Electronics N.V. Lamps produced according to the proposals in these applications may not, however, simultaneously meet acceptable lamp efficiency, color point, color stability, lumen maintenance, and reliability values for a commercial lamp.

Above mentioned application Ser. No. 11/951,677 discloses a lamp which includes an oxide of tungsten as an oxygen dispenser.

The exemplary embodiment provides a new and improved metal halide lamp with improved lumen maintenance.

BRIEF DESCRIPTION OF THE DISCLOSURE

In one aspect of the exemplary embodiment, a lamp includes a discharge vessel. Tungsten electrodes extend into the discharge vessel. An ionizable fill is sealed within the vessel. The fill includes a buffer gas, a halide component including a rare earth halide. A source of oxygen comprising a lanthanide oxide is present within the discharge vessel.

In another aspect, a lamp includes a discharge vessel. Tungsten electrodes extend into the discharge vessel. An ionizable fill is sealed within the vessel. The fill includes a buffer gas, a halide component including a rare earth halide. A lanthanide oxide is present in the discharge vessel. The lanthanide oxide is sealed in the vessel in a sufficient amount to maintain a concentration of $WO_2X_2$ in a vapor phase in the fill during lamp operation of at least $1\times10^{-9}$ μmol $cm^3$.

In another aspect, a method of forming a lamp includes providing a discharge vessel, providing tungsten electrodes which extend into the discharge vessel and introducing a source of available oxygen within the vessel. The source of available oxygen includes a lanthanide oxide in solid form.

One advantage of at least one embodiment is the provision of a discharge vessel with improved performance and lumen maintenance.

Another advantage of at least one embodiment resides in reduced wall blackening.

Another advantage is that a tungsten regeneration cycle is maintained between a wall of a discharge vessel and a portion of an electrode that is operating at a higher temperature than the wall.

Another advantage is ease of handling of a lanthanide oxide dose component by current doser equipment.

Still further advantages will become apparent to those of ordinary skill in the art upon reading and understanding the following detailed description of the preferred embodiments.

DETAILED DESCRIPTION OF THE PREFERRED EMBODIMENTS

Aspects of the exemplary embodiment relate to a lamp that is formulated to promote a tungsten regeneration cycle by enabling a higher solubility of tungsten species adjacent the wall of the lamp, where deposition would otherwise occur, than at the electrode, even though the electrode operates at a substantially higher temperature than the wall.

Figure 1:
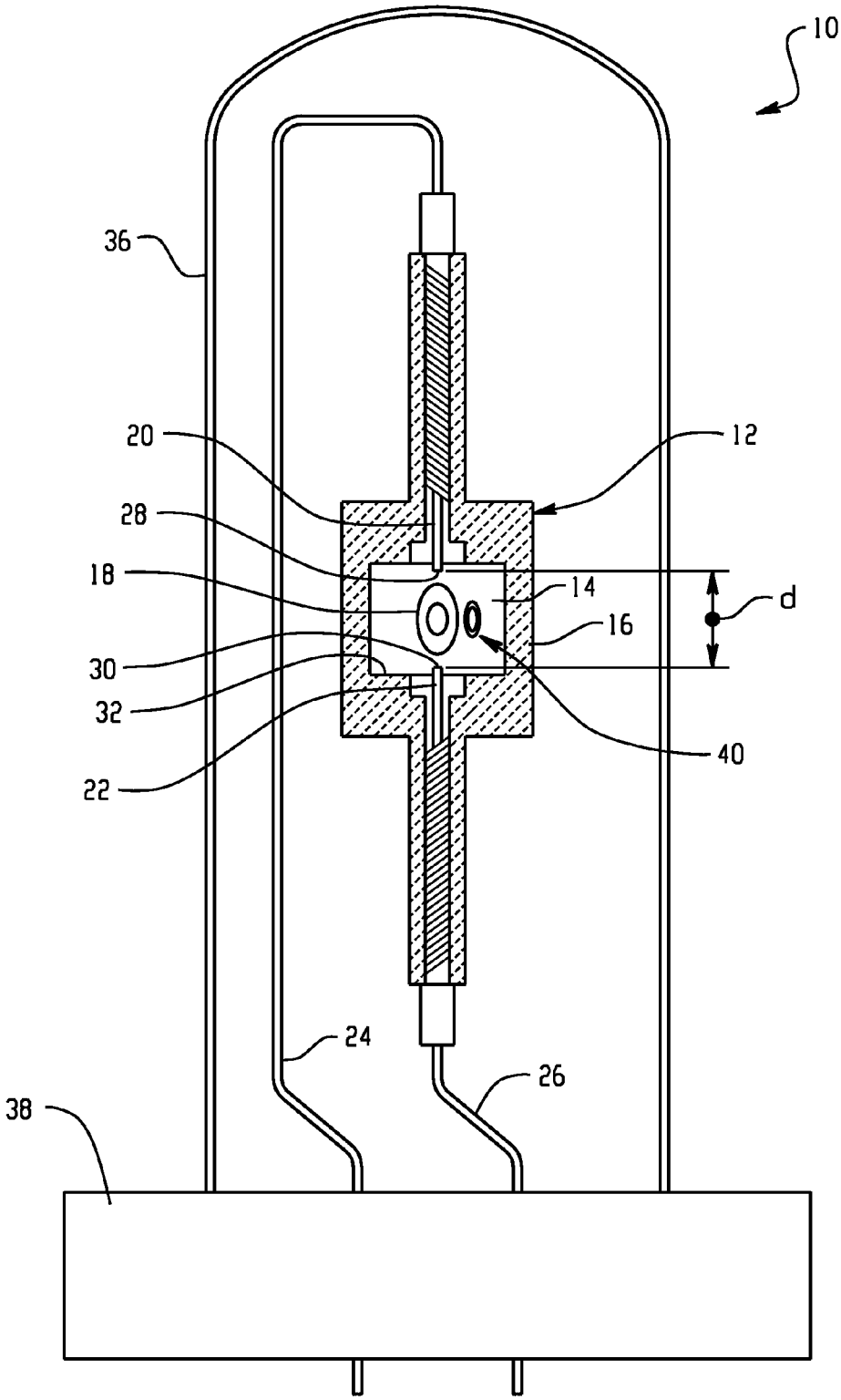
FIG. 1 is a cross-sectional view of an HID lamp according to the exemplary embodiment.

With reference to FIG. 1, a cross-sectional view of an exemplary HID lamp 10 is shown. The lamp includes a discharge vessel or arc tube 12, which defines an interior chamber 14. The discharge vessel 12 has a wall 16, which may be formed of a ceramic material, such as alumina, or other suitable light-transmissive material, such as quartz glass. An ionizable fill 18 is sealed in the interior chamber 14. Tungsten electrodes 20, 22 are positioned at opposite ends of the discharge vessel so as to energize the fill when an electric current is applied thereto. The two electrodes 20 and 22 are typically fed with an alternating electric current via conductors 24, 26 (e.g., from a ballast, not shown). Tips 28, 30 of the electrodes 20, 22 are spaced by a distance d, which defines the arc gap. When the HID lamp 10 is powered, indicating a flow of current to the lamp, a voltage difference is created across the two electrodes. This voltage difference causes an arc across the gap between the tips 28, 30 of the electrodes. The arc results in a plasma discharge in the region between the electrode tips 28, 30. Visible light is generated and passes out of the chamber 14, through the wall 16.

The electrodes become heated during lamp operation and tungsten tends to vaporize from the tips 28, 30. Some of the vaporized tungsten may deposit on an interior surface 32 of wall 16. Absent a regeneration cycle, the deposited tungsten may lead to wall blackening and a reduction in the transmission of the visible light.

While the electrodes 20, 22 may be formed from pure tungsten, e.g., greater than 99% pure tungsten, it is also contemplated that the electrodes may have a lower tungsten content, e.g., may comprise at least 50% or at least 95% tungsten.

The exemplary discharge vessel 12 is surrounded by an outer bulb 36 that is provided with a lamp cap 28 at one end, through which the lamp is connected with a source of power (not shown), such as mains voltage. The bulb 36 may be formed of glass or other suitable material. The lighting assembly 10 also includes a ballast (not shown), which acts as a starter when the lamp is switched on. The ballast is located in a circuit that includes the lamp and the power source. The space between the discharge vessel and outer bulb may be evacuated. Optionally a shroud (not shown) formed from quartz or other suitable material, surrounds or partially surrounds the discharge vessel to contain possible discharge vessel fragments in the event of an discharge vessel rupture.

The interior space 14 has a volume commensurate with the operating voltage of the lamp and sustainable wall loading. For example, for a 70 W lamp, the volume may be about 0.15 $cm^3$ to about 0.3 $cm^3$, e.g., about 0.2 $cm^3$, and for a 250 W lamp, the volume may be about 0.5 $cm^3$ to about 2.0 $cm^3$, e.g., about 1.35 $cm^3$.

The ionizable fill 18 includes a buffer gas, optionally mercury (Hg), and a halide component. A source 40 of available oxygen (an oxygen dispenser) comprising at least one lanthanide oxide is also present in the discharge vessel and is in contact with the fill during lamp operation. The source 40 may be present as a solid oxide. In some embodiments, the fill may further include a source of available halogen. The components of the fill 18, source 40, and their respective amounts are selected to provide a higher solubility of tungsten species at the wall surface 32 for reaction with any tungsten deposited there. The halide component includes a rare earth halide and may further include one or more of an alkali metal halide, an alkaline earth metal halide, and a Group IIIA halide (indium and or thallium halide). In operation, the electrodes 20, 22 produce an arc between tips 28, 30 of the electrodes, which ionizes the fill to produce a plasma in the discharge space. The emission characteristics of the light produced are dependent, primarily, upon the constituents of the fill material, the voltage across the electrodes, the temperature distribution of the chamber, the pressure in the chamber, and the geometry of the chamber. The source 40 of oxygen may also contribute to the emission characteristics. In the following description of the fill, the amounts of the components refer to the amounts initially sealed in the discharge vessel. i.e., before operation of the lamp, unless otherwise noted.

The buffer gas may be an inert gas, such as argon, xenon, krypton, or combination thereof, and may be present in the fill at from about 5-20 micromoles per cubic centimeter (μmol/$cm^3$) of the interior chamber 14. The buffer gas may also function as a starting gas for generating light during the early stages of lamp operation. In one embodiment, suited to CMH lamps, the lamp is backfilled with Ar. In another embodiment, Xe or Ar with a small addition of Kr85 is used. The radioactive Kr85 provides ionization that assists in starting the lamp. The cold fill pressure may be about 60-300 Torr, although higher cold fill pressures are not excluded. In one embodiment, a cold fill pressure of at least about 120 Torr is used. In another embodiment, the cold fill pressure is up to about 240 Torr. Too high a pressure may compromise starting. Too low a pressure can lead to increased lumen depreciation over life. During lamp operation, the pressure of the buffer gas may be at least about 1 atm.

The mercury dose, where present, may be present at from about 3 to 35 mg/$cm^3$ of the discharge vessel volume. In one embodiment, the mercury dose is about 20 mg/$cm^3$. The mercury weight is adjusted to provide the desired discharge vessel operating voltage (Vop) for drawing power from the selected ballast. In an alternative embodiment, the lamp fill is mercury-free.

The halide component may be present at from about 20 to about 80 mg/$cm^3$ of discharge vessel volume, e.g., about 30-60 mg/$cm^3$. A ratio of halide dose to mercury can be, for example, from about 1:3 to about 15:1, expressed by weight. The halide(s) in the halide component can each be selected from chlorides, bromides, iodides and combinations thereof. In one embodiment, the halides are all iodides. Iodides tend to provide longer lamp life, as corrosion of the discharge vessel and/or electrodes is lower with iodide components in the fill than with otherwise similar chloride or bromide components. The halide compounds usually will represent stoichiometric relationships.

In one embodiment, the rare earth halide may be one that is selected in type and concentration such that it does not form a stable oxide by reaction with the source of oxygen, i.e., it forms an unstable oxide. By this it is meant that it permits available oxygen to exist in the fill during lamp operation. Exemplary rare earth halides which form unstable oxides include halides of lanthanum (La), cerium (Ce), praseodymium (Pr) neodymium (Nd), samarium (Sm), gadolinium (Gd), and combinations thereof. The rare earth halide(s) of the fill can have the general form $REX_3$, where RE is selected from La, Ce, Pr, Nd, Sm, and Gd, and X is selected from Cl, Br, and I, and combinations thereof. An exemplary rare earth halide from this group is lanthanum halide.

The rare earth halide may be present in the fill at a total concentration of, for example, at least about 3 μmol/$cm^3$. The rare earth halide concentration may be up to about 13 μmol/$cm^3$ The rare earth halide may be present at a molar concentration of at least 2% of the halides in the fill, e.g., at least about 8 mol % of the halides in the fill.

In one embodiment, only rare earth halides from this limited group of rare earth halides (La, Ce, Pr, Nd, Sm, and Gd) are present in the fill. In this embodiment, the lamp fill thus is free of other rare earth halides, by which it is meant that all other rare earth halides are present in a total amount of not more than about 0.1 μmol/$cm^3$. In particular the fill is free of halides of the following rare earth elements: terbium, dysprosium, holmium, thulium, erbium, ytterbium, lutetium, and yttrium. Other halides which form stable oxides are also not present in the fill, such as scandium halides and magnesium halides.

The alkali metal halide, where present, may be selected from sodium (Na), potassium (K), and cesium (Cs) halides, and combinations thereof. In one specific embodiment, the alkali metal halide includes sodium halide. The alkali metal halide(s) of the fill can have the general form AX, where A is selected from Na, K, and Cs, and X is as defined above, and combinations thereof. The alkali metal halide may be present in the fill at a total concentration of, for example, from about 20 to about 300 μmol $cm^3$.

The alkaline earth metal halide, where present, may be selected from calcium (Ca), barium (Ba), and strontium (Sr) halides, and combinations thereof The alkaline earth metal halide(s) of the fill can have the general form $MX_2$, where M is selected from Ca, Ba, and Sr, and X is as defined above and combinations thereof In one specific embodiment, the alkaline earth metal halide includes calcium halide. The alkaline earth metal halide may be present in the fill at a total concentration of, for example, from about 10 to about 100 μmol/$cm^3$. In another embodiment, the fill is free of calcium halide.

The group IIIa halide, where present, may be selected from thallium (Tl) and indium (In) halides. In one specific embodiment, the group IIIa halide includes thallium halide. The group IIIa halide(s) of the fill may have the general form LX or $LX_3$, where L is selected from Tl and In, and X is as defined above. The group IIIa halide may be present in the fill at a total concentration of, for example, from about 1 to 10 μmol/$m^3$.

As previously noted, the source 40 of available oxygen includes at least one lanthanide oxide. The source 40 is one that, under the lamp operating conditions, makes oxygen available for reaction with other fill components to form tungsten oxyhalide ($WO_2X_2$). The source of available oxygen may thus be an oxide that is unstable under lamp operating temperatures. However, in some embodiments, the source of available oxygen may further include other sources, such as oxygen gas ($O_2$), water, molybdenum oxide, mercury oxide, or combination thereof.

The lanthanide oxide can have the general form: $Ln_nO_m$, where Ln represents a lanthanide selected from the group consisting of lanthanum (La), cerium (Ce), praseodymium (Pr), neodymium (Nd), samarium (Sm), gadolinium (Gd) and combinations thereof, $n \geqq 1$, and $m \geqq 2$. Exemplary lanthanide oxides include $LnO_2$, and $Ln_6O_{11}$.

Heretofore, it was not apparent that certain oxides, such as cerium oxide, could decompose readily to form available oxygen under lamp operating conditions and thus act effectively as sources of oxygen. It has been found that certain rare earth oxides, such as certain lanthanide oxides, are able to release oxygen. This is believed to be derived from the ability of these oxides to undergo a transformation between two different oxidation states with different oxygen stoichiometries. For example, in the +4 oxidation state, the present exemplary lanthanide combines with oxygen forming the stable form of $LnO_2$. However, when exposed to an oxygen depleted environment, the $LnO_2$ readily releases oxygen transforming to its most reduced +3 oxidation state to form $Ln_2O_3$ as shown in Eqn. 1.

$$4LnO_2 \rightarrow 2Ln_2O_3 + O_2(g) \quad \text{Eqn. 1}$$

The following equations represents some of the reactions for exemplary lanthanide oxides:

$$4CeO_2 \rightarrow 2Ce_2O_3 + O_2(g)$$

$$4PrO_2 \rightarrow 2Pr_2O_3 + O_2(g)$$

$$4NdO_2 \rightarrow 2Nd_2O_3 + O_2(g)$$

$$Pr_6O_{11} \rightarrow 3Pr_2O_3 + O_2(g)$$

The energy for conversion of the higher oxidation state oxide to the lower oxidation state is provided by the energy of the lamp during operation. For example, $CeO_2$ can be converted to $Ce_2O_3$ at a temperature of about 800° C., which is typically exceeded in lamp operation.

In comparison to tungsten oxide ($WO_3$), which releases all of the attached oxygen, in changing from the +4 to the +3 oxidation state, $CeO_2$ and other $LnO_2$ oxides release one quarter of the attached oxygen. Therefore, 0.12 mg of $CeO_2$ releases the same molar amount of $O_2$ as 0.027 mg of $WO_3$. Other lanthanide dioxides are similar. $Pr_6O_{11}$ releases a smaller proportion by weight of $O_2$. An advantage of this is that the larger amount of $LnO_2$ is more feasible to handle in production compared to the smaller amount of $WO_3$.

The source 40 of available oxygen (e.g. $LnO_2$) may be present in an amount sufficient to provide a total of at least $10^{-2}$ μmol/$cm^3$ of oxygen in the discharge space (i.e., when the lanthanide oxide is converted from its introduced form, e.g., as $LnO_2$, to its lower oxidation state). In one embodiment, the source 40 of available oxygen is present in a sufficient amount to provide at least $5\times10^{-2}$ μmol/$cm^3$ of $O_2$, and in one embodiment, up to about 20 μmol $cm^3$ of $O_2$ in the discharge space. The source of available oxygen, in the case of $LnO_2$, yields 1 mole of $O_2$ for every four moles of $LnO_2$. The lanthanide oxide may thus be present in the fill in an amount of at least about $4\times10^{-2}$ mol $cm^3$ of the discharge space, e.g., at least about 0.1 μmol/$cm^3$, and in some embodiments, at least about 1 μmol/$cm^3$, and may be up to about 80 μmol/$cm^3$ of the discharge space, or greater. For example, the lanthanide oxide may be present at 0.2-7.0 μmol/$cm^3$ and in one embodiment, from 0.2-3.6 μmol/cm3. For lanthanide oxides which produce more $O_2$ per mol of oxide, such as $Pr_6O_{11}$, the molar amounts can be correspondingly lower although the weight used is higher. Additionally, if other sources of oxygen, such as $WO_2$, are combined with the lanthanide oxide, the minimum amount of $LnO_2$ introduced to the discharge vessel can be correspondingly lowered.

The amount added may depend, to some degree on the anticipated lifetime of the lamp. While in theory, the same amount of lanthanide oxide could be used, irrespective of lamp lifetime, it has been found that, over time, some of the oxygen generated may be depleted. Thus, somewhat more lanthanide oxide may be added to compensate for this for lamps which are designed to operate for over 20,000 hrs.

The lanthanide oxide can be introduced to the discharge vessel in the form of a fine powder, grains, a pure crystal, a pellet, an oxide layer, e.g., on the electrode/discharge vessel wall, a combination thereof, or the like. For example, in one embodiment the lanthanide oxide is in pellet form with dimensions in the range of about 0.30-0.35 mm. The size of the pellet may be selected to allow introduction to the arc tube. The lanthanide oxide may be the sole component of the pellet or may be combined with other components, such as a carrier material and/or other component(s) of the fill, such as one or more of the halides to be used.

The lanthanide oxide may be introduced to the discharge vessel by hand or using an automated dispenser. For example, lanthanide oxide may be introduced to the discharge vessel using an automated dispenser as a pellet, a spherical, or other suitable shape. In other embodiments, the lanthanide oxide may be introduced along with inserting the tungsten electrodes which extend into the discharge vessel, e.g., as a layer on a part of the electrode.

In one embodiment, the discharge vessel, when formed, is free of all rare earth oxides other than oxides of lanthanum, cerium, praseodymium, neodymium, samarium, and gadolinium. In another embodiment, the fill is free of rare earth oxides of terbium, dysprosium, holmium, erbium, thulium, ytterbium, lutetium, scandium, and yttrium. By free, it is meant that these oxides are present in no greater than normal impurity amounts as part of the discharge vessel, electrodes, and/or other components of the fill, e.g., are each present in the discharge vessel/electrodes at a total concentration of less than about 10 ppm.

The source of available halogen as previously discussed in application Ser. No. 11/951,677, where present, may be generally an unstable halide or other halogen containing compound, which is capable of increasing the concentration of vapor phase $WO_2X_2$, through one or more reactions occurring during lamp operation, where X is as defined above. The source of free halogen may be a compound capable of reacting directly or indirectly with tungsten metal, tungsten-containing species, or a compound of tungsten to form $WO_2X_2$. The source of available halogen may be a halide selected from mercury halides, such as $HgI_2$, $HgBr_2$, $HgCl_2$, and combinations thereof.

In one specific embodiment, the lamp fill, when the lamp is formed, i.e. before operation, consists essentially of a buffer gas, free mercury, a lanthanide oxide, such as cerium oxide, and a halide component consisting essentially of a rare earth halide selected from the group consisting of lanthanum halides, cerium halide, neodymium halides, samarium halides, and gadolinium halides, and combinations thereof, and at least one of an alkali metal halide, an alkaline earth metal halide and a halide of an element selected from In and Tl.

An exemplary fill composition for a 70 W lamp may be formulated as shown in Table 1:

TABLE 1

| Fill component | 70 W lamp (μmol/cm$^3$) |
|---|---|
| Ar | 11.0 |
| Hg | 102.0 |
| NaI | 139.0 |
| $CaI_2$ | 35.0 |
| TlI | 8.0 |
| $LnI_3$ | 13.0 |
| $LnO_2$ | 2.5-6.6 |

The fill is formulated to provide conditions which favor regeneration, i.e., favor the solubility of tungsten in the fill 18 at the wall 32 while favoring the redeposition of the solubilized tungsten at the electrode(s) 20, 22. The electrode temperature during lamp operation may be about 2500-3200K at the electrode tip 28, 30, and in one embodiment, is maintained at a temperature of less than about 2700K. Regeneration can be achieved by selecting the lamp fill to provide a higher solubility of tungsten species adjacent the wall than at the electrode tip.

The regeneration is achieved even though the wall 32 of the discharge vessel, where significant tungsten deposition would otherwise occur, is at a lower temperature than the electrode tip 28 or 30 (or other portion of the electrode on which the tungsten is redeposited). For example, the wall may be at a temperature that is at least 200K lower than the portion of the electrode on which redeposition occurs, and in general, is at least 500K lower.

Figure 2:
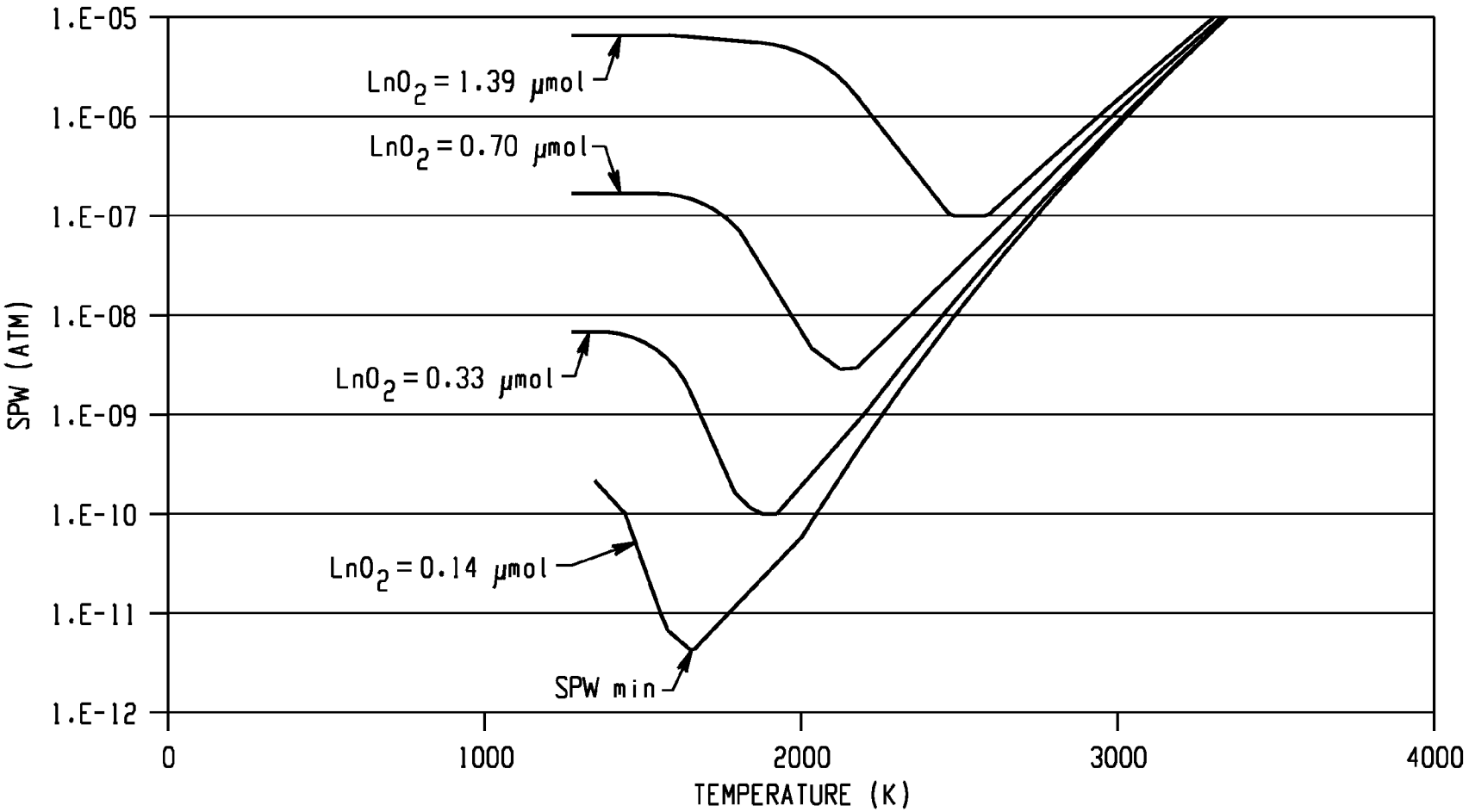
FIG. 2 illustrates theoretical plots of the combined solubility of all tungsten species vs. temperature for different amounts of a lanthanum oxide ($LnO_2$) as a source of available oxygen, present in an exemplary lamp with a 0.3 $cm^3$ lamp volume.

FIG. 2 illustrates theoretical thermodynamic calculations for the solubility of tungsten species vs. temperature for different amounts of $CeO_2$ as a source of available halogen present in a 0.3 cm$^3$ lamp volume. SPW represents the summed pressures in atmospheres of all tungsten species present in vapor form. Typically, the tungsten species adjacent the wall 32 is primarily $WO_2I_2$ vapor and at the electrode 20, 22 may be a mixture of species, such as W, WI, $WI_2$, $WI_3$, $WI_4$ and $WO_2I_2$ vapor. As can be seen from FIG. 2, each plot passes through a trough where the solubility is lowest (e.g., at SPW min.). The present exemplary embodiment takes advantage of this trough by selecting a cerium oxide concentration such that the electrode tip temperature falls closer to the trough, i.e., a lower SPW, than the wall. In general, the SPW at the electrode tip (or wherever on the electrode solubility is lowest) should be no more than 90% of the SPW at the wall to encourage regeneration. Thus, for example, with a $CeO_2$ dose of 0.14 μmol, where the wall temperature is about 1300K during operation and the tip temperature is about 2200K, the SPW would be higher at the electrode tip 28, 30 than at the wall 32, and thus regeneration would not be favored. However, when a dose of 0.33 μmol $CeO_2$ is used for these temperatures, the trough shifts to higher temperatures and the SPW at the tip 28, 30 is lower than at the wall 32.

Figure 3:
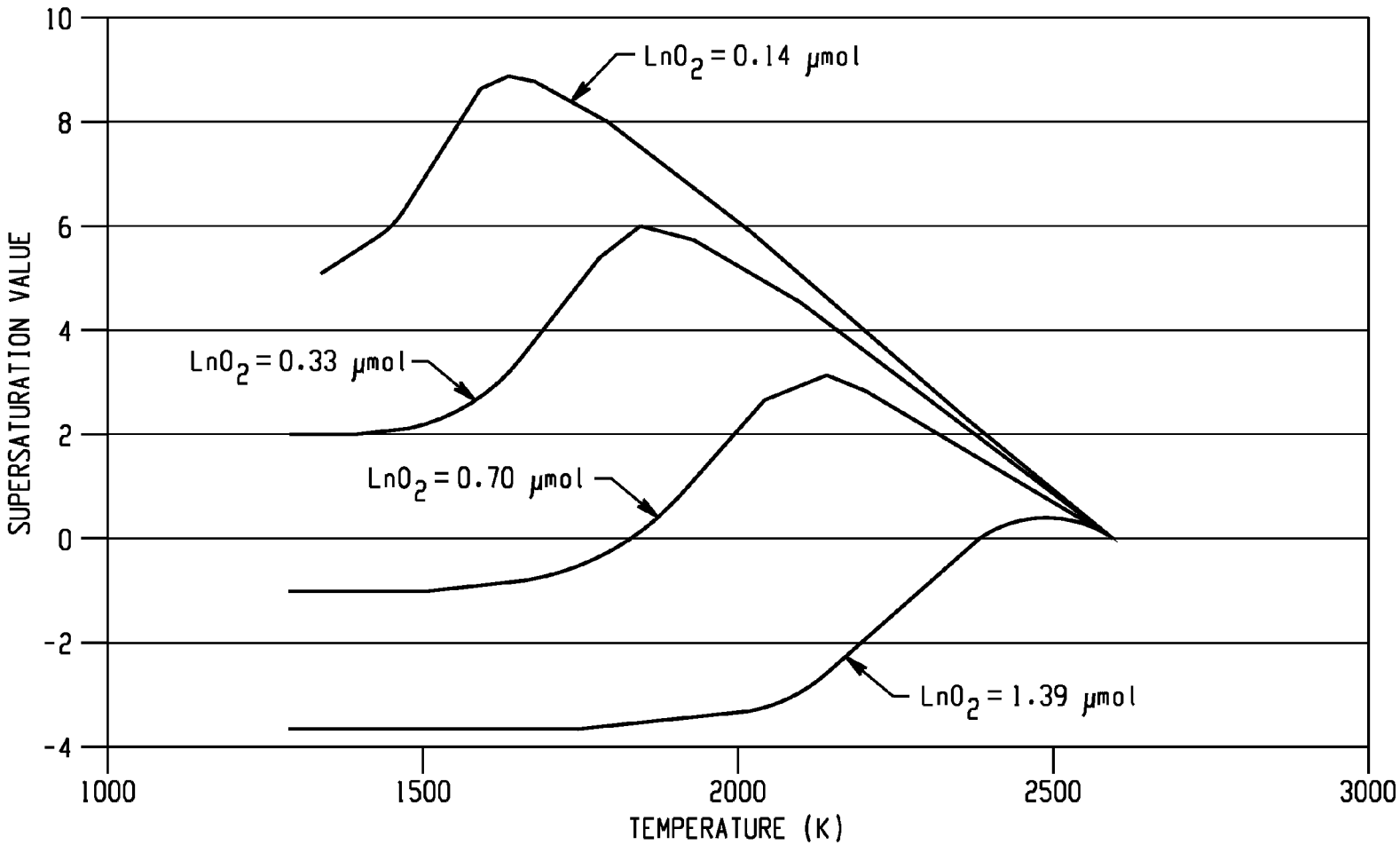
FIG. 3 illustrates theoretical plots of the supersaturation of tungsten species vs. temperature in K for different amounts of a lanthanide oxide ($LnO_2$) as a source of available oxygen, present in an exemplary 0.3 $cm^3$ lamp volume.

FIG. 3 illustrates theoretical thermodynamic calculations of the supersaturation of tungsten species vs. temperature in K, where $$\text{Supersaturation Value} = \text{Ln}\left[\frac{SPWTe}{SPWTs}\right]$$

where SPWTe is the SPW at the temperature of the electrodes 20, 22 (2600K) and SPWTs is the SPW at the temperature of the wall surface 32. This means is that if the value is <0, the SPW established by vapor with equilibrium at the arctube wall, i.e., by vapor in contact with tungsten deposited on the wall, is larger than the SPW for at least one point on the electrode surface, thus there is a driving force for W deposition from the vapor phase to the electrode for at least that one point—and perhaps over wider regions if the value is <0 over a range of electrode temperatures. In general, lower supersaturation values are more favorable, although if the supersaturation value becomes too negative, it may be undesirable. Values within the range of 0.70-1.39 μmol shown in FIG. 3 are generally acceptable, however.

Knowing the temperature of the discharge vessel wall 32 in the region where blackening due to tungsten deposition is most likely to occur and the temperature of the electrode tip 28, 30, in lamp operation, a suitable amount of a lanthanide oxide can be determined which favors regeneration while minimizing the effect on other lamp properties.

Without being bound by any particular theory, it is believed that the lanthanide oxide leads to an increase in $WO_2I_2$ in the vapor and thus is capable of decreasing W supersaturation and increasing wall cleaning.

Since cerium does not influence the color of the emitted light significantly, this allows for the $CeO_2$ to be present in relatively high amounts without impacting the color rendering of the lamp significantly. For lanthanides which have a greater impact on color of the emitted light, the amount may be chosen to minimize the influence on light color, while still providing the beneficial effects of reduced wall blackening.

In various aspects, the ballast is selected to provide the lamp, during operation, with a wall loading of at least about 30 W/cm$^2$. The wall loading may be at least about 50 W/cm$^2$, and in some embodiments, about 70 W/cm$^2$, or higher. Below about 25-30 W/cm$^2$, the discharge vessel walls tend to be too cool for efficient maintenance of the active tungsten halogen cycle. As defined herein, the discharge vessel wall loading (WL)=W/A where W is the total discharge vessel power in watts and A is the area in $cm^2$ of the discharge vessel wall which is located between the electrode tips 28, 30. The discharge vessel power is the total discharge vessel power including electrode power. In general the dose and wall loading are sufficient to maintain a wall temperature of at least about 600K, e.g., 1000-1400K.

In the case of a ceramic discharge vessel, the ceramic metal halide discharge vessel 12 can be of a three part construction, and may be formed, for example, as described, for example, in any one of U.S. Pat. Nos. 5,866,982 6,346,495; 7,215,081; and U.S. Pub. No. 2006/0164017. It will be appreciated that the discharge vessel 12 can be constructed from fewer or greater number of components, such as one or five components. The parts are formed as green ceramic and bonded in a gas tight manner by sintering or other suitable method. An exemplary discharge vessel can be constructed by die pressing or injection molding, and extruding a mixture of a ceramic powder and a binder into a solid cylinder. The ceramic powder may comprise high purity alumina ($Al_2O_3$), optionally doped with magnesia. Other ceramic materials which may be used include non reactive refractory oxides and oxynitrides such as yttrium oxide, lutetium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters. Subsequent to die pressing or injection molding and extrusion, the binder is removed from the green part, typically by thermal pyrolysis, e.g., at about 900-1100° C., to form a bisque-fired part. The sintering step may be carried out by heating the bisque-fired parts in hydrogen at about 1850-1880° C. The resulting ceramic material comprises a densely sintered polycrystalline alumina.

In other embodiments, the discharge vessel is formed of quartz glass and can be formed of one piece.

The lanthanide oxide can be introduced to the discharge vessel, e.g., thorough one of the leg members, prior to insertion of the electrodes. Alternatively, it may be introduced through a fill port (not shown) in a wall of the discharge vessel which is subsequently sealed.

The exemplary lamp finds use in a variety of applications, including highway and road lighting, lighting of large venues such as sports stadiums, floodlighting of buildings, shops, industrial buildings, automotive lighting, such as headlights, and in projectors.

Without intending to limit the scope of the disclosure, the following example demonstrates the formation of lamps with improved lumen maintenance.

EXAMPLE

Discharge vessels 12 were formed according to the shape shown in FIG. 1 from three component parts. The discharge vessel had an internal volume of 0.294 $cm^3$. Exemplary lamps, denoted cells A. B, and C, were formed from the discharge vessels. The fills of exemplary lamps A, B, and C were as follows: Hg (102 μmol/$cm^3$), NaI (139 μmol/$cm^3$), $CaI_2$ (35 μmol/$cm^3$), TlI (8 μmol/$cm^3$) Ar (11 μmol/$cm^3$) $LaI_3$ (13 μmol/$cm^{3)}$ in addition to a pill of $CeO_2$ as the source of oxygen. The pills were formed solely of $CeO_2$.

The lanthanide oxide may be at least 99% pure, by weight, e.g., at least 99.9% pure and can be up to 99.999% pure. Various lanthanide oxides of 99.9% purity are obtainable from METALL RARE EARTH LIMITED, 12 Floor, AT Tower, 180 Electric Road, North Point, Hongkong, China.

Table 2 shows sample $CeO_2$ pill sizes used in the lamps. N is the number of lamps tested for each design cell A, B, and C. In some tests, the cerium oxide pill was introduced into the discharge vessel by hand. In another tests, cerium oxide was incorporated using a commercial doser (available from APL Engineered Materials, Inc). This particular doser allows cerium oxide to be introduced into the arc tube of the lamp by a device including a stainless steel container with a small porous lid.

TABLE 2

| Cell | $CeO_2$ | Method to Dose | N |
|---|---|---|---|
| A | 0.24 mg | By Hand | 9 |
| B | 0.18 mg | By Hand | 9 |
| C | 0.18 mg | By APL Doser | 8 |

The lamps were run in a standard burning cycle (11 hrs. on followed by 1 hour off) for extended periods in a vertical-base-up orientation (i.e., at 90 degrees to that illustrated in FIG. 1) on a ballast at 70 W.

Table 3 shows the results obtained after 100, 500, and 1000 hrs. V is the burning voltage. Lumens is the lumen output of the lamp. LPW is the lumens per watt. % Lumen, i.e. lumen maintenance, is the lumens at a certain burning hour as expressed as % of lumens at 100 hours. X color and Y color are the chromaticity X and Y respectively; on a standard CIE (Commission Internationale de l'Eclairage) chromaticity diagram in which the chromaticity coordinates X and Y represent relative magnitudes of two of the three primary colors. CRI is the color rendering index and is a measure of the ability of the human eye to distinguish colors by the light of the lamp, higher values being favored. CCT is the correlated color temperature of the lamp which is the color temperature of a black body which most closely matches the lamp's perceived color. Dccy is the difference in chromaticity of the color point, on the Y axis (Y color), from that of the standard black body curve. The results are the mean of the N lamps in the cell.

TABLE 3

| Cell | Burning Hr | V | Lumens | LPW | % Lumen | X Color | Y Color | CCT | CRI | Dccy |
|---|---|---|---|---|---|---|---|---|---|---|
| A | 100 | 99.4 | 5749 | 79.8 | 100.0 | 0.4525 | 0.4117 | 2815 | 86.2 | 0.0030 |
| B | 100 | 95.5 | 6326 | 87.9 | 100.0 | 0.4500 | 0.4092 | 2833 | 85.9 | 0.0011 |
| C | 100 | 93.1 | 6414 | 89.1 | 100.0 | 0.4465 | 0.4102 | 2895 | 85.0 | 0.0031 |
| A | 500 | 99.0 | 5959 | 82.8 | 104.8 | 0.4450 | 0.4106 | 2921 | 86.0 | 0.0039 |
| B | 500 | 94.6 | 6549 | 91.0 | 103.6 | 0.4413 | 0.4097 | 2972 | 84.9 | 0.0041 |

TABLE 3-continued

| Cell | Burning Hr | V | Lumens | LPW | % Lumen | X Color | Y Color | CCT | CRI | Dccy |
|---|---|---|---|---|---|---|---|---|---|---|
| C | 500 | 93.7 | 6589 | 91.5 | 102.8 | 0.4420 | 0.4122 | 2982 | 84.8 | 0.0065 |
| A | 1000 | 99.1 | 5928 | 82.3 | 104.2 | 0.4454 | 0.4111 | 2919 | 86.1 | 0.0044 |
| B | 1000 | 94.8 | 6497 | 90.2 | 102.8 | 0.4391 | 0.4107 | 3017 | 85.0 | 0.0057 |
| C | 1000 | 93.2 | 6515 | 90.5 | 101.6 | 0.4424 | 0.4126 | 2979 | 85.0 | 0.0068 |

As can be seen, the lumens and lumen efficacy (LPW) of the lamps with the lower $CeO_2$ dose (cells B and C) was higher at each burning hour, although the lamps with the higher $CeO_2$ dose (cell A) had a higher lumen maintenance at 500 hours, and 1000 hours.

A two-sample t-test was used to compare whether the average difference between the hand-dosed and doser-dosed cells was significant. The results are shown in Tables 4 and 5. These show no significant differences between the hand-dosed cell B and APL-dosed cell C in 100 hours of lamp performance for both CRI and lumens. Mean is the average of CRI and Lumen respectively for sample number N. Standard Deviation (St. Dev.) is a measure of the dispersion of the collection of sample CRI and Lumen values respectively. The SE Mean is the standard error of a method of measurement and P is the probability of obtaining a result at least as extreme as the one that was actually observed. As shown in Tables 4 and 5, since both samples have a P-value above 0.05 (5 percent), it can be concluded that there is no difference between the means.

TABLE 4

Two Sample T for CRI

| Cell | N | Mean | St. Dev. | SE Mean |
|---|---|---|---|---|
| B | 9 | 85.889 | 0.928 | 0.31 |
| C | 8 | 85.000 | 1.07 | 0.38 |

P = 0.090

TABLE 5

Two Sample T for Lumens

| Cell | N | Mean | St. Dev. | SE Mean |
|---|---|---|---|---|
| B | 9 | 6326 | 152 | 51 |
| C | 8 | 6414 | 163 | 58 |

P = 0.027

Similar tests were performed to determine whether the results for the two pill sizes were significantly different. Tables 6, 7, 8, and 9 show analysis of variance for CRI (Tables 6 and 7) and lumens (Tables 8 and 9) respectively. Analysis of Variance (ANOVA) is a test for significant differences between means. N, Mean and St Dev are as described above. SS is the sum of the squared deviations. P is as described above. As shown in Tables 7 and 9, since the samples have a P-value below 0.05 (5 percent), it can be concluded that there is a difference between the means. It can therefore be concluded that the 0.18 mg $CeO_2$ dose yields more lumens than a 0.24 mg $CeO_2$ dose. The CRI results are similar for the two dosages.

TABLE 6

| Level | N | Mean | St. Dev |
|---|---|---|---|
| A | 9 | 86.222 | 0.833 |
| B | 9 | 85.889 | 0.928 |
| C | 8 | 85.000 | 1.069 |

TABLE 7

| Source | SS | P |
|---|---|---|
| Cell | 6.671 | 0.039 |
| Error | 20.444 | |
| Total | 27.115 | |

TABLE 8

| Cell | N | Mean | St. Dev |
|---|---|---|---|
| A | 9 | 5748.6 | 233.3 |
| B | 9 | 6326.2 | 151.7 |
| C | 8 | 6414.1 | 163.0 |

TABLE 9

| Source | SS | P |
|---|---|---|
| Cell | 2287719 | 0.00 |
| Error | 805237 | |
| Total | 3092956 | |

In a comparative study, five lamps were formed as for the cells A, B, and C, with the same discharge vessel geometry and dose but without a lanthanide oxide oxygen dispenser. The results for these cells (labeled D) at 100 hrs, 500 hrs, and 1000 hrs are shown in Table 10 below. The average values and standard deviation (Sigma) are also provided.

TABLE 10

| Cell | Lamp | Hours | V | Lumens | LPW | % Lumen |
|---|---|---|---|---|---|---|
| G | 1 | 100 | 101.1 | 6155 | 85.5 | 100 |
| G | 2 | 100 | 100.1 | 6309 | 87.7 | 100 |
| G | 3 | 100 | 100.7 | 6419 | 89.2 | 100 |
| G | 4 | 100 | 102.2 | 6228 | 86.6 | 100 |
| G | 5 | 100 | 100.6 | 6205 | 86.3 | 100 |
| Average: | | | 101.1 | 6263 | 87.1 | 100 |
| Sigma: | | | 0.9 | 103 | 1.4 | 0 |
| G | 1 | 500 | 100.5 | 5962 | 82.8 | 96.9 |
| G | 2 | 500 | 99.5 | 6119 | 84.9 | 97.0 |
| G | 3 | 500 | 98.3 | 6116 | 84.9 | 95.3 |
| G | 4 | 500 | 99.8 | 6202 | 86.1 | 99.6 |
| G | 5 | 500 | 100.2 | 5891 | 81.9 | 94.9 |
| Average: | | | 99.7 | 6058 | 84.1 | 96.7 |
| Sigma: | | | 0.9 | 127 | 1.7 | 1.8 |
| G | 1 | 1000 | 100.5 | 5624 | 78.1 | 91.4 |

TABLE 10-continued

| Cell | Lamp | Hours | V | Lumens | LPW | % Lumen |
|---|---|---|---|---|---|---|
| G | 2 | 1000 | 99.4 | 5916 | 82.1 | 93.8 |
| G | 3 | 1000 | 99.6 | 5961 | 82.8 | 92.9 |
| G | 4 | 1000 | 99.3 | 6002 | 83.4 | 96.4 |
| G | 5 | 1000 | 98.8 | 5535 | 76.9 | 89.2 |
| Average: | | | 99.5 | 5808 | 80.6 | 92.7 |
| Sigma: | | | 0.6 | 213 | 2.9 | 2.7 |

It can be seen from these results that the exemplary lamps, on average, outperform the lamps without the $CeO_2$ oxygen dispenser.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

a discharge vessel;

tungsten electrodes extending into the discharge vessel;

an ionizable fill sealed within the vessel, the fill comprising:

a buffer gas, a lanthanide halide component consisting of a rare earth halide selected from the group consisting of lanthanum, cerium, praseodymium, neodymium, samarium, gadolinium, and combinations thereof; and a source of oxygen within the discharge vessel, wherein the source of oxygen consists of an oxide of a lanthanide selected from the group consisting of lanthanum, cerium, praseodymium, neodymium, samarium, gadolinium, and combinations thereof, which has an oxidation state greater than 3 and forms an unstable oxide, and is present in an amount such that the solubility of tungsten species in the fill during lamp operation is lower adjacent at least a portion of one of the electrodes than at a wall of the discharge vessel, such that tungsten from the electrode that would otherwise be deposited on the wall during lamp operation is transported back to the electrode to improve lumen maintenance.

2. The lamp of claim 1, wherein the lanthanide oxide comprises a lanthanide element having at least two oxidation states and during lamp operation, is converted from a higher of the oxidation states to a lower of the oxidation states.

3. The lamp of claim 1, wherein the lanthanide oxide comprises at least one of a cerium oxide and a lanthanum oxide.

4. The lamp of claim 1, wherein the lanthanide oxide has the general form:

$Ln_nO_m$, where Ln represents a lanthanide selected from the group consisting of lanthanum, cerium, praseodymium, neodymium, samarium, gadolinium and combinations thereof, $n \geqq 1$, and $m \geqq 2$.

5. The lamp of claim 1, wherein the lanthanide oxide is present in the discharge vessel at a concentration of at least 0.1 micromoles/$cm^3$.

6. The lamp of claim 5, wherein the lanthanide oxide is present in the discharge vessel at a concentration of at least 1.0 micromoles/$cm^3$.

7. The lamp of claim 1, wherein the lanthanide oxide is present in the discharge vessel at a concentration of up to 80 micromoles/$cm^3$.

8. The lamp of claim 1, wherein the discharge vessel is free of lanthanide oxides of terbium oxide, dysprosium oxide, holmium oxide, erbium oxide, thulium oxide, ytterbium oxide, lutetium oxide, scandium oxide, and yttrium oxide.

9. The lamp of claim 1, wherein the fill further comprises free mercury.

10. The lamp of claim 1, wherein the rare earth halide comprises at least one of a lanthanum halide and a cerium halide.

11. The lamp of claim 1, wherein the rare earth halide is present in the fill at a total concentration of 3-14 μmol/$cm^3$.

12. The lamp of claim 1, wherein the fill is free of rare earth halides of terbium halide, dysprosium halide, holmium halide, erbium halide, thulium halide, ytterbium halide, lutetium halide, scandium halide, and yttrium halide.

13. The lamp of claim 1, wherein the fill further includes at least one of the groups consisting of a mercury halide, an alkali metal halide, an alkaline earth metal halide, and a halide of thallium and indium.

14. The lamp of claim 1, where during lamp operation, the fill includes $WO_2X_2$ in vapor form, where X is selected from chlorine, bromine, and iodine.

15. The lamp of claim 1, where during lamp operation, the wall of the discharge vessel is at a temperature that is at least 200K lower than the portion of the electrode.

16. The lamp of claim 1, wherein during lamp operation, the wall is at a temperature that is no more than 800K lower than the portion of the electrode.

17. The lamp of claim 1, wherein in operation, the temperature adjacent at least the portion of one of the electrodes is higher than a temperature at which the solubility of tungsten in the vapor phase is at a minimum and a temperature at the wall of the discharge vessel is higher than the temperature at which the solubility of tungsten in the vapor phase is at the minimum.

18. A method of operating a lamp comprising:

providing the lamp of claim 1; and operating the lamp by supplying an alternating current to the lamp to generate a discharge in the lamp vessel, whereby the source of oxygen generates available oxygen for reacting with tungsten deposited on the wall of the vessel to generate a soluble tungsten species, the soluble tungsten species being deposited on the electrodes.

19. The method of claim 18, wherein, during lamp operation, the temperature adjacent at least the portion of one of the electrodes is higher than a temperature at which the solubility of tungsten in the vapor phase is at a minimum and a temperature at the wall of the discharge vessel is higher than the temperature at which the solubility of tungsten in the vapor phase is at the minimum.

20. A lamp comprising:

a discharge vessel;

tungsten electrodes extending into the discharge vessel;

an ionizable fill sealed within the vessel, the fill comprising:

a buffer gas, a lanthanide halide component consisting of a rare earth halide selected from the group consisting of lanthanum, cerium, praseodymium, neodymium, samarium, gadolinium, and combinations thereof; and a lanthanide oxide consisting of an oxide of a lanthanide selected from the group consisting of lanthanum, cerium, praseodymium, neodymium, samarium, gadolinium, and combinations thereof sealed in the vessel in a sufficient amount to maintain a concentration of $WO_2X_2$ in a vapor phase in the fill during lamp operation of at least $1\times10^{-9}$ μmol/cm$^3$, where X represents a halide.

21. A method of forming a lamp comprising:

providing a discharge vessel, providing tungsten electrodes which extend into the discharge vessel; and introducing, an ionizable fill sealed within the vessel, the fill comprising:

a buffer gas, a lanthanide halide component consisting of a rare earth halide selected from the group consisting of lanthanum, cerium, praseodymium, neodymium, samarium, gadolinium, and combinations thereof; and a source of available oxygen within the discharge vessel, the source of available oxygen consisting of an oxide of a lanthanide selected from the group consisting of lanthanum, cerium, praseodymium, neodymium, samarium, gadolinium, and combinations thereof, in solid form which has an oxidation state greater than 3 and forms an unstable oxide, in a sufficient amount to maintain a concentration of $WO_2X_2$ in a vapor phase in the fill during lamp operation of at least $1\times10^{-9}$ μmol/cm$^3$, where X represents a halide.

* * * * *